United States Patent [19]

Walter

[11] Patent Number: 4,648,637

[45] Date of Patent: Mar. 10, 1987

[54] REMOVABLE LATCH MECHANISM

[76] Inventor: Ernest J. Walter, 2913 Caldwell Ave., Ontario, Calif. 91761

[21] Appl. No.: 657,176

[22] Filed: Oct. 3, 1984

[51] Int. Cl.[4] ..... E05C 19/12

[52] U.S. Cl. ..... 292/128; 292/DIG. 71

[58] Field of Search ..... 292/128, 228, 121, 220, 292/DIG. 9, DIG. 71; 16/380, 386

[56] References Cited

U.S. PATENT DOCUMENTS

| | | | |
|---|---|---|---|
| 466,267 | 12/1891 | Clark | 16/380 |
| 1,021,885 | 4/1912 | Peterson | 16/386 X |
| 1,047,191 | 12/1912 | Fontannaz | 292/DIG. 9 X |
| 1,450,151 | 3/1923 | Filbrick | 292/128 |
| 2,230,476 | 2/1941 | Anderson | 292/128 |
| 2,345,432 | 3/1944 | Schweller | 292/128 |
| 2,775,111 | 12/1956 | Savage | 292/228 |
| 3,220,759 | 11/1965 | Miller | 292/228 X |
| 3,263,269 | 8/1966 | McGahee | 16/380 |
| 3,709,538 | 1/1973 | Seitz et al. | 292/128 |
| 4,261,605 | 4/1981 | Hock | 292/228 |

*Primary Examiner*—Robert L. Wolfe
*Assistant Examiner*—Russell W. Illich
*Attorney, Agent, or Firm*—Blakely, Sokoloff, Taylor & Zafman

[57] ABSTRACT

A latch mechanism having easily removed components for cleaning. The apparatus is comprised of a strike and latch member which are releasably engagable. The latch is rotatably mounted and spring biased toward the strike. The spring biasing element is wedged between the rocker plate member and the edge surface of the door. A pivot pin upon which the rocker plate member is rotatably mounted is slideably removeable therefrom. Thus, the pivot pin, rocker plate member, and spring biasing element can be removed and placed so that all surfaces of the permanently affixed elements of the latch mechanism are completely exposed for cleaning, and such that the removable elements can be emersed and sanitized.

2 Claims, 5 Drawing Figures

REMOVABLE LATCH MECHANISM

BACKGROUND OF THE INVENTION

Food storage and preparation cabinets and enclosures are commonly found in kitchens, restaurants, and other facilities where food is prepared. Such cabinets are used in a wide variety of applications including food warming, cooling, and transporting. Because of the environments in which they are used, the doors of such cabinets are constantly being opened and closed. Typically, these doors are maintained in a releasably closed position by a latching means such as a magnetized or mechanical biasing element, and are opened by manually grasping a handle or indentation provided in the door. Thus, prior art food handling cabinets and enclosures typically require that at least one hand be free by the operator for some duration in order to open them. Thus, placing and removing food from cabinets, which is often contained in bulky carriers, can prove to be very difficult.

One solution to this problem is disclosed in U.S. Pat. No. 4,261,605. The '605 Patent discloses a latching mechanism external to the cabinet and includes a biasing means for releasing the latch mechanism with the application of momentary contact pressure with a single hand or foot thus, only momentary use of a free hand is required.

Further, because this latch is primarily external to the door and has many of the surfaces exposed, it is relatively easy to clean. Thus, the accumulation of food, dirt, and debris which can create an unsanitary and unhealthful condition in a food handling environment is minimized to some degree.

However, the '605 latch mechanism, while solving some of the above problems, still suffers the drawback of having hidden surfaces and locations which are not easily accessible for cleaning. Thus, it still cannot meet the stringent requirements of certain sanitary codes. The problem of accessibility for cleaning is particularly acute underneath the rocker plate member of the latch mechanism, and in areas in and around the biasing element.

SUMMARY OF THE INVENTION

Accordingly, it is an object of the present invention to provide a latch mechanism for releasably maintaining a door of a cabinet which can be swiftly and easily actuated with a hand or foot, and closed in a similar fashion.

It is a further object of the present invention to provide a latching mechanism for a cabinet which is easily accessible for cleaning, and which incorporates removable components so that inaccessible surfaces of the latch mechanism can be reached, and so that the removable components can be emersed for cleaning.

The present invention discloses a removable latch mechanism for use on heating cabinets and other food handling and preparation equipment. The latch incorporates a pair of butt members which have cylindrical bores therethrough. The butt members are mounted onto the edge of cabinet's door panel. A removable rocker plate member, which has a cylindrical bore defined therethrough, is mounted between the butt members and secured in place by a cylindrical pivot pin that is slideably receivable through the cylindrical bores of the butt members and rocker plate member.

The rocker plate member incorporates a lip along the edge of the rocker plate member nearest to the body of the cabinet which protrudes downwardly toward the cabinet. Mounted to the particular body of the cabinet along its edge adjacent to the edge of the door where the rocker plate member is located is a strike for releasably engaging a rocker plate member. The strike includes an upwardly protruding lip along its leading edge nearest to the edge of the cabinet. Thus, the lips of the rocker plate member and the strike engage to maintain the door in a closed position.

A removable leaf spring is securedly wedged between the edge surface of the door and the underside of the rocker plate member, and continually biasing the rocker plate member toward its engaged position. Further, the leading edge surfaces of the lips have slick surfaces such that when the door is swung closed or quickly disengaged the lips slide past each other. Thus, upon closing the door, the slips of the lips will ride over one another so that the lips can ultimately engage. Likewise, when releasing the latch mechanism, they will slide such that the latch will not catch and therefore may not resist disengagement.

A bend is provided near the upper end of the pivot pin. This bend serves as a stop so that the pivot pin will not slide completely through the cylindrical bores, but rather will be retained therein. Further, the bend provides for a means to grasp the pivot pin for removing it from the cylindrical bores. The assembly and disassembly of the removable latch mechanism components for cleaning is a simple operation. To remove these components, the pivot pin is simply removed by sliding it upwardly through the cylindrical bores of the butt members and rocker plate member. Once the pivot pin is completely removed, the rocker plate member can simply be lifted from between the butt members, and the leaf spring is thereby dislodged between the rocker plate member and the edge surface of the door. Thus, all exposed surfaces of the remaining components on the door, which are permanently affixed thereto, can be cleaned by wiping them down with a cloth or sponge with the appropriate disinfectant. Also the pivot pin, rocker plate member and leaf spring can be emersed in a sanitizing solution and dried for thorough cleaning.

Reassembly of the latch mechanism is accomplished as easily as disassembly. The leaf spring is first aligned along the door's edge between the butt members. Next, the rocker plate member is pressed against the leaf spring until it is aligned between the cylindrical bores of the butt members. Next, the pivot pin is slideably engaged through the cylindrical bores of the upper butt member, the rocker plate member, and the lower butt member respectively. The bend at the upper end of the pivot pin can be turned to lay flush and aligned with door and also with the upper surface of the butt member so that it will not interfere or catch with clothing or other objects, and will remain securely in place.

These objects and others accomplished by the present invention will become more apparent upon a reading of the specification and the drawings in which like reference numerals refer to like parts throughout and in which:

DETAILED DESCRIPTION OF THE INVENTION

Figure 1:
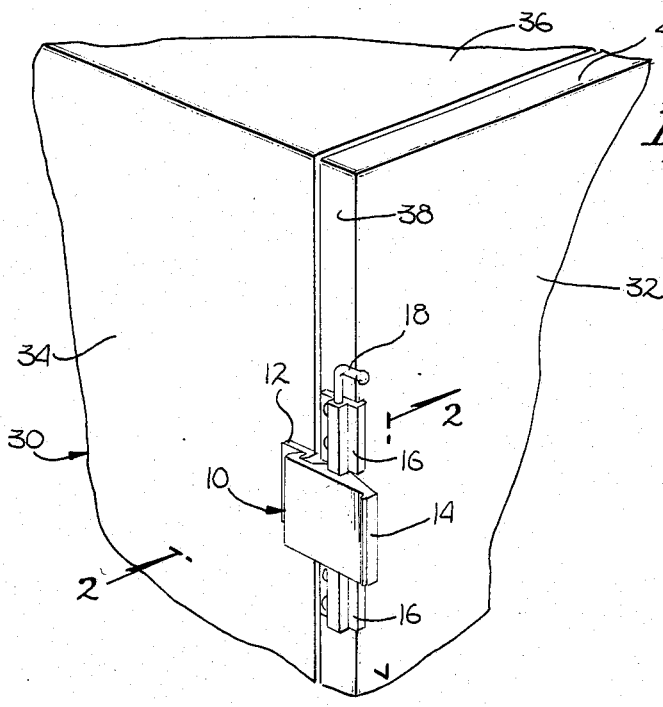
FIG. 1 is a perspective view of the present invention mounted on the side edge of a door and the panel of the cabinet adjacent to the side edge.

In the following discussion, the same reference numeral will designate like elements throughout.

Referring to FIG. 1, the removable latch mechanism 10 of the present invention is generally shown. The latch mechanism is particularly well suited for use in food handling and preparation environments. In such environments, it is important for health purposes and for relevant health and sanitation code requirements that all latch surfaces subject to the collection of dirt and debris be readily accessible for thorough cleaning. The present invention provides for easy accessibility to all exposed surfaces, and for removability of certain latch mechanism components for thorough cleaning.

The latching mechanism is designed to releasably maintain a door 32 such as is used in food heating cabinets, in a closed position against the body of cabinet 30. The latch mechanism is comprised of a strike 12, rocker plate member 14, butt members 16 and pivot pin 18. The latching mechanism also comprises a leaf spring 20 as clearly shown in FIG. 3.

The latch mechanism is mounted on an edge surface of the door 32 and adjacent body panel 34 of cabinet 30. As shown in FIG. 1, the latch mechanism is mounted on the edge surface 38 of the door 32 and the adjacent cabinet body panel 34. Alternatively, the latch mechanism can be mounted on door edge surface 40 and cabinet body panel 36, as desired.

In the embodiment shown, strike 12 is securely mounted on panel 34, and butt members 16 are mounted on the door edge surface 38. It should be appreciated, however, that positions of the strike and the butt members and their associated components can be reversed.

Figure 2:
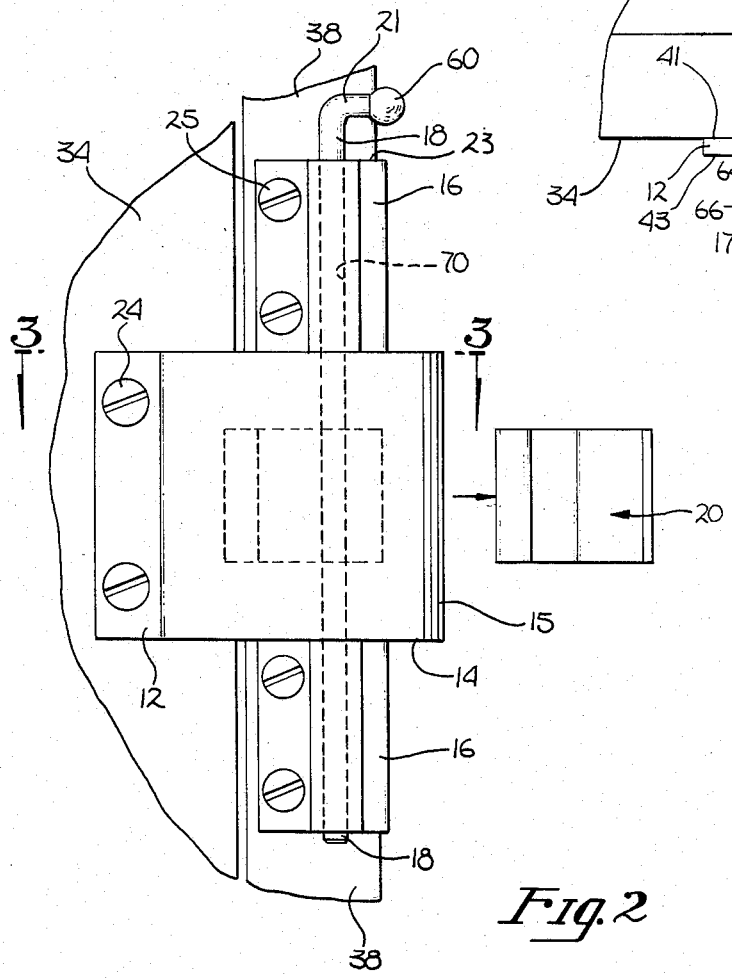
FIG. 2 is a plan view of the present invention taken along line 2—2 of FIG. 1.

Referring now to FIG. 2, strike 12 and butt members 16 are shown mounted on the panel 34 and the edge surface 38, respectively, by means of screws 24 and 25. The butt members 16 have a cylindrical bore 70 which passes longitudinally therethrough to receive removable pivot pin 18. The butt members 16 are mounted so that the cylindrical bores are substantially parallel to the junction line formed by the junction of the door and the body panel of the cabinet in the area of the latch mechanism.

Figure 3:
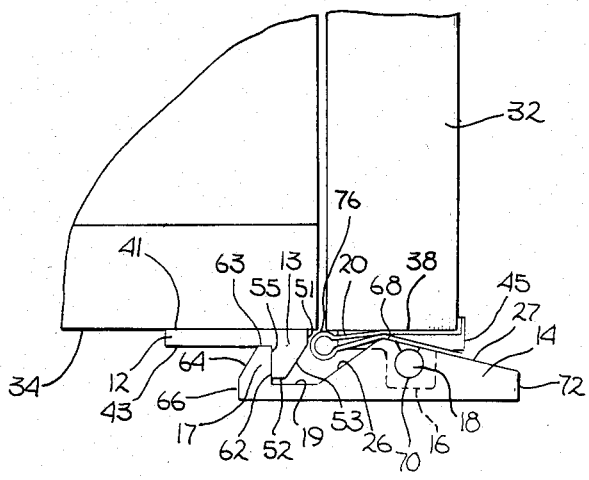
FIG. 3 is a side view of the present invention in the engaged position taken along line 3—3 of FIG. 2.
Figures 4, 5:
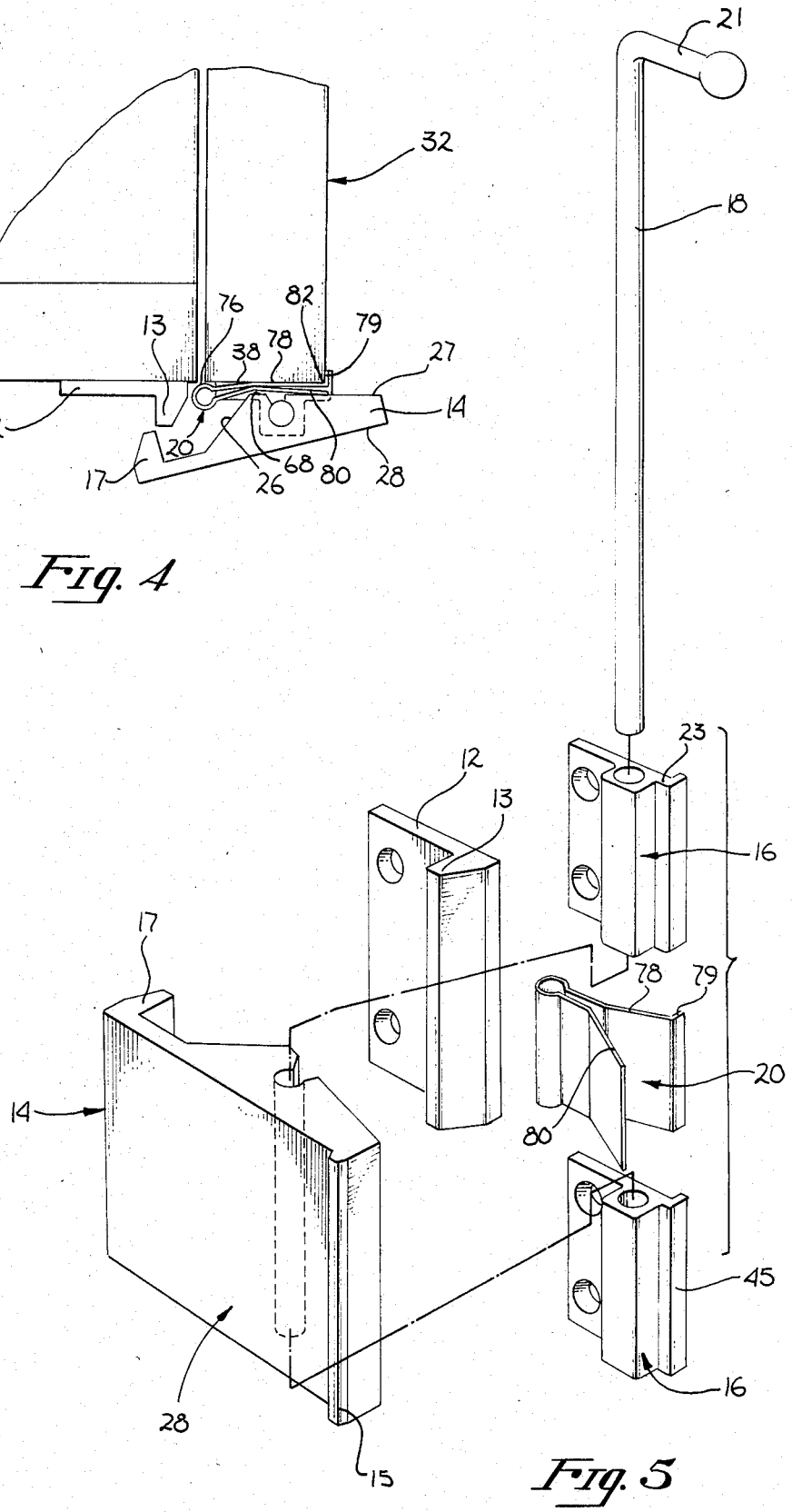
FIG. 4 illustrates the present invention as shown in FIG. 3, but in the disengaged position.
FIG. 5 is a perspective view of the latch mechanism of the present invention showing the removable components in an exploded view.

Removable pivot pin 18 has a circular cross-section, as best shown in FIGS. 3 and 4 to allow the rotation of the rocker plate member 14 which is pivotally mounted thereon between the butt members 16. Correspondingly, the rocker plate member 14 has a cylindrical bore therethrough to align with the centerline of the cylindrical bores of the butt members 16. The pivot pin 18 engages with the cylindrical bores and maintains a sliding fit therewith. The pivot pin has a right angle bend 21 near the top thereof, which acts as a stop to abut the upper end surface 23 of the upper butt member 16, as best illustrated in FIG. 5. A knob 60 is provided on the upper end of the pivot pin, so that it can be slidably removed or engaged through the cylindrical bores as desired, as will be described in further detail herein.

Directional orientation of the present invention is defined with numeral 41 designating the bottom surface of strike 12, and numeral 43 designating its top surface as shown in FIG. 3, and with pivot pin 18 extending in the longitudinal direction. The bottom surface of the strike 12 is mounted against panel 34 with its leading edge 51 adjacent the junction between the door 32 and the panel 34. Lip 13 protrudes upwardly from the top surface of the strike along the leading edge 51, and extends longitudinally along that edge, and has rear surface 55 which forms a right angle with the top surface of the strike. The lip 13 is further defined by its front surface 53 which slopes down and away from the upper terminous 52 of the lip 13 to the leading edge 51 of the strike.

The removable rocker plate member 14 is mounted along the door edge surface 38 between butt members 16, as best illustrated in FIG. 2, and pivots about pivot pin 18 during engagement and disengagement of the latch mechanism.

The rocker plate member 14 further includes a lip 17 which protrudes downwardly therefrom extending along the leading edge thereof. The lip 17 has substantially the same contour as lip 13 of the strike, but protrudes downwardly rather than upward so that the opposing lips 13 and 17 are engagable to hold the latch mechanism closed. The lip 17 has a rear surface 62 which forms a right angle with the planar surface 19 of the rocker plate member 14. The lip 17 is further defined by its front surface 64 which slopes down and away from the upper terminous 63 of the lip toward the leading edge 66 of the rocker plate member.

The lower surface of the rocker plate member 14 includes: (a) a ridge 68 adjacent to the cylindrical bore 70 between the bore 70 and the lip 17, (b) a first downwardly sloping surface 26 extending from the ridge 68 toward the lip 17, and (c) a second downwardly sloping surface 27 which extends toward the outer terminal edge 72 of the rocker plate member.

Referring now to FIG. 4, a removable leaf spring 20, wedged between the lower surface 27 of the rocker plate member and the edge surface 38 of the door, provides the necessary spring force to urge the rocker plate member toward its engaged position so that it will remain in there unless intentionally removed therefrom. The leaf spring 20 is designed to be held in position without fastening means so that it can be easily removed for cleaning.

The leaf spring is formed of a single piece of sheet metal (spring steel) bent, into the appropriate shape, such as by stamping. The leaf spring 20 has a bend 76 which has a substantially circular cross-section, which divides the spring into two opposing divergent leaves 78 and 80. When the spring is completely unstressed, the leaves 78 and 80 diverge beyond the area that will accommodate their divergent width when in place between the rocker plate 14 and the edge surface 38 of the door. Thus, when in place, the leaves urge toward their unstressed condition, providing the desired spring force to retain the spring in place and to bias the rocker arm member.

The lower planar leaf 78 of the spring abuts the edge surface 38 of the door. Also, a lip 79 extends downwardly from the terminous of the lower leaf 78 so that a corner is formed which abuts the outer corner 82 of the door edge surface 38.

A second leaf 80 urgently abuts the second downwardly sloping surface 27 of the rocker plate member 14. The cylindrical bend 76 of tne spring rides over the ridge 68 of the rocker plate member 14 and abuts the first downwardly sloping surface 26 thereof over the ridge. Thus, the spring is retained in place by the urgent force of the leaves and is fixed in position by the lip 79 and bend 76 which are constrained by their respective abutting surfaces.

The upper surface 28 of the rocker plate has a sufficiently large rectangular surface to provide ample surface contact area to operate the switch easily with one hand. In operation, rocker plate member 14 is released from engagement with strike 12 by the application of pressure on upper surface 28 at the end of the latch member opposite from lip 17. This counteracts the bias of the leaf spring 20 and allows the rocker plate member to rotate so that there is clearance between the lips 13 and 17, respectively, as shown in FIG. 4. When this occurs the door 32 may be swung open, and will do so automatically if spring loaded or otherwise mechanically biased towards the open position.

Downwardly sloping surfaces 26 and 27 are configured to define the arc through the lower surface of the rocker plate member 14 on either side of the pivot axis through which rocker plate member may rotate. Adequate clearance is provided to allow sufficient upward rotation of the rocker plate member such that the second lip 17 clears the first lip 13 when they are in vertical alignment.

In operation, when door 32 is open, rocker plate member 14 is biased downward to a limited extent. As the door is closed, the front surface 64 of the lip 17 of the rocker plate collides with front surface 53 of the lip 13 of the strike. The lip 17 then rebounds from the collision and clears the upper edge 52 of front surface 53. The front surface 53 and front surface 64 are set at angles such that they will slide over one another if the door is swung shut. As the door continues forward with momentum, lip 17 passes lip 13 and rotates downwardly, urged by the leaf spring 20 until the rear surfaces 55 and 62 of the lips 13 and 17 engage. The latch mechanism will remain in this engaged position until removed therefrom by the application of pressure to the upper surface 28 urging the rotation of the rocker plate member, and thus removing the lips from interfering engagement.

Ridges 15 longitudinally extend upwards from the otherwise flat surface 28 from the end of the rocker plate where the disengaging pressure is to be applied to help prevent the users hand from slipping off it when making contact. (See FIGS. 2 and 5.)

Because key components of the latch mechanism can be removed, and the latch mechanism subsequently reassembled without the use of tools, all exposed surfaces of the latch mechanism are easily accessible for cleaning. Referring now to FIG. 5, an exploded view of the latch mechanism with its removable elements disengaged is shown. To clean the latch mechanism, pivot pin 18 is slidably removed from the cylindrical bores of the butt members 16 and the rocker plate member 14 by holding the pin at its upward end near the bend area and pulling it upward. This disengages the rocker plate member 14 and dislodges the independent leaf spring 20 wedged between the rocker plate member 14 and the edge surface of the door. Thus, the pin, rocker plate member, and spring can be fully immersed in a cleaning solution to remove all traces of bacteria, dirt and debri. Further, surfaces exposed on the permanently attached components of the latch mechanism are also easily accessible for cleaning.

To reassemble the latch mechanism, the leaf spring 20 is placed between the butt members 16 so that the lip 79 and leaf 78 abut the corner of the door edge surface. Then, the rocker plate member is placed over the spring so that the bend of the spring rides over the ridge of the rocker plate member. The rocker plate member is then pressed inwardly, urging the leaves of the spring to fold inwardly about the bend. The rocker plate member is pressed sufficiently inward to align the cylindrical bore thereof with the bores of the butt members. The pivot pin is then slidably engaged through the bores of the butt members and rocker plate member retaining it in place.

In the preferred embodiment, butt members 16 will be made with overhang 45 longitudinally extending downwards from the side of the butt member intended to be adjacent the outside corner of edge surface 38 when said butt members are mounted thereon. (See FIG. 3.) This overhang facilitates alignment of the butt members so that pin 18 contained therein is parallel to the junction line formed between the junction of the door and panel 34. In turn, this helps insure the proper alignment of the second lip 17 of the latch member with the first lip 13 of the strike 12.

In the above description, the invention has been disclosed by way of example and by discussion of the preferred embodiment. However, variations and modifications may be made without departing from the spirit and scope of the invention disclosed herein.

I claim:

1. A latch mechanism comprising:

a. a pair of butt members for being mounted to the edge surface of a door each butt member having a cylindrical aperture defined longitudinally therethrough;

b. a removable rocker plate member having a cylindrical bore defined longitudinally therethrough, said rocker plate member including a lip protruding along the leading edge thereof, said lip having a first surface which forms substantially a right angle with the upper surface which forms substantially a right angle with the upper surface of said rocker plate member, and a second surface which slopes down and away from the upper terminus of said first surface;

an upper surface for receiving manual contact for opening and closing said latch mechanism, a lower surface having a ridge adjacent to said cylindrical bore between said bore and said lip, a first downwardly sloping surface extending from said ridge toward said lip, and a second downwardly sloping surface extending toward the outer edge of said rocker plate member;

c. a cylindrical pivot pin removably receivable through said cylindrical bores in said butt members and said rocker plate member, said pivot pin including a retaining means at at least one end thereof for retaining said pivot pin within said bores, such that said rocker plate is pivotal about said pivot pin, and said pivot pin is removable without the use of tools;

d. a strike member including an outwardly extending lip along the longitudinal axis thereof, said lip having a first surface which forms a substantially right angle with said strike, and a second surface that slopes down and away from the upper terminus of said first surface toward the leaning edge of said strike, such that the slope surface of said lip of said rocker plate and said strike slide over each other when said strike and said rocker plate member are brought into engagement so that said lips will latchedly engage to retain said latch mechanism in its closed position; and e. a removable sheet metal spring having a first leaf which abuts the edge surface of said door, a lip extending downwardly from the terminous of said first leaf such that said spring is urgently retained along the outer corner of said door edge surface, a second leaf opposing said first leaf and urgently abutting the lower surface of said rocker plate between the cylindrical bore and the outer terminious of said rocker plate, and a bulbous bend substantially bisecting said first and second leaves such that said bend rides over said ridge of said rocker plate and abuts the downwardly sloping surface of said rocker plate over said ridge, said pivot pin, said rocker plate and said spring being aligned such that said spring provides an urgent moment to continually urge said rocker plate into its normally closed position and providing only nominal compressive forces substantially perpendicular to said pivot pin such that said pivot pin is freely engageable and removable by hand, whereby said leaves are urged outwardly from said bend when said spring is in its unconstrained condition, and whereby said spring is securely retained between said rocker plate and said edge surface of said door in its constrained condition, and urges said rocker plate to pivot about said pivot pin toward its engaged position.

2. The pivot pin as claimed in claim 1 wherein said retainer means comprises a bend near the upper end of said pin such that said pin is slidable upwardly, and such that said bend acts as a stop for retaining said pivot pin in place, and wherein said pin is slidably removable by hand by pulling said pin out by the upper end portion thereof whereby said rocker plate member, biasing means and pivot pin can be disengaged from said latch mechanism for cleaning without the use of tools.

* * * * *